United States Patent [19]

Herbert

[11] 4,223,650

[45] Sep. 23, 1980

[54] EXHAUST GAS RECYCLING SYSTEM

[76] Inventor: Sumter Herbert, 379 Beech St., Pottstown, Pa. 19464

[21] Appl. No.: 934,220

[22] Filed: Aug. 16, 1978

[51] Int. Cl.[3] ..... F02M 25/06

[52] U.S. Cl. ..... 123/568

[58] Field of Search ..... 123/119 A

[56] References Cited

U.S. PATENT DOCUMENTS

| | | | |
|---|---|---|---|
| 1,371,397 | 3/1921 | Ricardo | 123/119 A |
| 1,476,942 | 12/1923 | Youngblood | 123/119 A |
| 1,533,775 | 4/1925 | Thomas | 123/119 A |
| 2,354,179 | 7/1944 | Blanc | 123/119 A |
| 2,419,747 | 4/1947 | Wassman | 123/119 A |

FOREIGN PATENT DOCUMENTS

| | | | |
|---|---|---|---|
| 396834 | 8/1933 | United Kingdom | 123/119 A |

*Primary Examiner*—Wendell E. Burns

*Attorney, Agent, or Firm*—Otto John Munz

[57] ABSTRACT

An exhaust gas recycling system for reducing nitrogen oxides discharged into the atmosphere by internal combustion engines, comprises an exhaust manifold having a baffle therein and a bypass pipe leading from the exhaust manifold to the air intake of the carburetor for returning a portion of the exhaust gases to the inlet of the carburetor in direct dependence upon the vacuum in the inlet to the carburetor, thus automatically recycling a substantial portion of the exhaust gases during those periods of operation when such recycling is desired, i.e., during acceleration and normal operation, when the vacuum at the carburetor inlet is high, and recycling only a minimal quantity of exhaust gases during those periods of operation when such recycling is not desired, i.e., during cranking, idling, deceleration and high load operation, when vacuum in the carburetor air intake is low.

1 Claim, 1 Drawing Figure

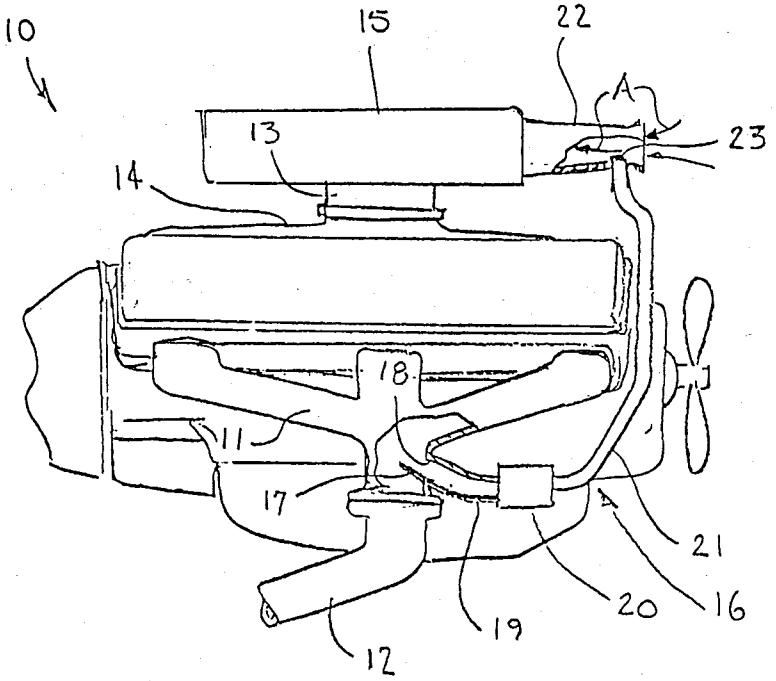
10
14
15
22
13
23
A
11
18
17
21
12
19
20
16

EXHAUST GAS RECYCLING SYSTEM

BACKGROUND OF THE INVENTION

1. Field of the Invention

This invention relates generally to internal combustion engines, and more particularly, to means for such an engine which reduces the pollutants discharged into the atmosphere by the engine. More specifically, the invention relates to an apparatus which recirculates or recycles a portion of the exhaust gases from the engine back to the inlet of the carburetor so that the exhaust gases may be burned, thereby reducing the nitrogen oxides discharged into the atmosphere with the exhaust gas from the engine.

2. Prior Art

It is well known that the presence of nitrogen oxide in the exhaust gas from gasoline engines is one of the major causes of air pollution and that the quantity of nitrogen oxide present in the exhaust gas can be reduced by recirculating the exhaust gas through the engine for recombustion.

Accordingly, many efforts have been made in the prior art to design systems for recirculating a portion of the exhaust gas to thereby reduce the emmission of nitrogen oxide into the atmosphere. Examples of some such prior art efforts are exemplified by U.S. Pat. Nos. 3,636,934, 3,807,375, 3,924,589, 3,927,523 and 4,075,992.

It is also known, and all of the aforementioned patents recognize, that in order for the performance of the engine not to be adversely affected, the recirculation of the exhaust gases must be regulated to comply with the mode of operation of the engine. In other words, during certain operations of the engine, as for example cranking, idling, deceleration or high load operation, recirculation of a substantial quantity of exhaust gases would not only adversely affect the performance of the engine and cause fouling of the plugs and combustion chambers thereof, but would also tend to increase pollution of the atmosphere. Alternatively, during acceleration and normal operation of the engine, recirculation of a substantial quantity of the exhaust gases is desired for recombustion of the exhaust gases to thereby reduce the amount of nitrogen oxides present in the exhaust gas.

All of the devices known to applicant, and including those disclosed in the aforementioned patents, comprise apparatus wherein the exhaust gases are recirculated from the exhaust of the engine back to the intake manifold of the engine downstream of the throttle valve in the carburetor. Since the vacuum or pressure condition present in the intake manifold of the engine depends upon both the speed of operation of the engine and the throttle setting of the carburetor, the quantity of exhaust gas recirculated to the intake manifold will thus also depend upon these factors. Therefore, in order to insure that the proper proportion of exhaust gas is recirculated to the intake of the engine during the various modes of operation thereof, separate valve means have been provided in the bypass from the exhaust to the intake manifold to control the flow of the recirculated exhaust gases. Control of these valves has been accomplished by means of thermally responsive devices, pressure responsive devices and direct mechanical linkage devices. Such devices are not only relatively expensive and complicated but are also subject to failure due to the highly corrosive nature of the exhaust gases which are encountered.

SUMMARY OF THE INVENTION

According to the present invention, a simple and economical structure is provided wherein a bypass line is connected from the exhaust manifold of the engine back to the air intake of the carburetor on the engine, and upstream of the throttle valve of the carburetor, to recirculate a portion of the exhaust gases back through the engine for recombustion, in direct dependence upon the operating condition of the engine. No expensive and complicated valves are used, with their correspondingly expensive and complicated control systems, and therefore there are no moving parts subject to failure as in the prior art devices known to applicant. The apparatus of the present invention utilizes the valve in the carburetor to, in effect, control the proportion of the exhaust gases recirculated. In other words, during idling, cranking, deceleration and high load conditions a relatively low vacuum exists at the inlet to the carburetor and thus very little exhaust gases are recirculated, and the amount of exhaust gases which are recirculated are insufficient to adversely affect the performance of the engine. On the other hand, during acceleration and normal operating conditions of the engine, the vacuum at the intake to the carburetor is relatively high and a proportionately greater amount of exhaust gases are therefore recirculated through the engine for recombustion. In other words, the greater the degree of opening of the throttle valve of the carburetor, the greater will be the vacuum at the air inlet to the carburetor, and in all but a few rare instances the degree of throttle opening corresponds very closely to the aforementioned modes of operation of the engine, whereby the proper amount of exhaust gases are recycled through the engine.

OBJECTS OF THE INVENTION

Accordingly, it is an object of this invention to provide an exhaust gas recycling apparatus for internal combustion engines which is simple and economical in construction and which is durable in operation.

Another object of the invention is to provide an exhaust gas recycling system for internal combustion engines wherein a portion of the exhaust gases are recirculated from the exhaust of the engine back to the air intake of the carburetor of the engine and wherein the system does not utilize any moving parts in addition to those already present on conventional engine components.

BRIEF DESCRIPTION OF THE DRAWING

The single FIGURE is a somewhat diagramatic showing of an engine with the exhaust gas recycling system of the invention applied thereto.

DETAILED DESCRIPTION OF THE PREFERRED EMBODIMENT

An internal combustion engine 10 has an exhaust manifold 11 attached thereto leading to an exhaust pipe 12. A carburetor 13 is supported on an intake manifold 14 connected to the engine, and an air cleaner housing 15 is attached to the carburetor 13.

The exhaust gas recycling system of the invention is indicated generally at 16 and comprises a baffle 17 fixedly mounted in the exhaust manifold and directing a portion of the exhaust gases to an opening 18 formed in the side of the manifold. A first bypass pipe or conduit section 19 is connected to the manifold at the opening 18 and extends to a silencer 20. A second pipe or conduit section 21 extends from the silencer 20 to the air inlet horn 22 of air cleaner housing 15. The second bypass pipe or conduit section 21 has an open end 23 disposed inside the air cleaner horn 22 such that air flowing thereover, as indicated by the arrows A, creates a venturi action to draw exhaust gases through the recirculating system and into the air cleaner and through the carburetor into the engine for recombustion of the exhaust gases.

The recirculating system of the invention is exceptionally simple and economical in construction and may be added to existing vehicles or provided on newly manufactured vehicles. In this connection, the baffle 17 and first bypass section 19 may be integrally formed with the manifold 11, or the baffle 17 and first bypass section 19 may comprise a pipe inserted through an opening 18 formed in the manifold 11.

The exhaust gas recycling system of the invention may by used in lieu of, or in combination with, other anti-pollution devices.

As this invention may be embodied in several forms without departing from the spirit or the essential characteristics thereof, the present embodiment is, therefore, illustrative and not restrictive, since the scope of the invention is defined by the appended claims rather than by the description preceeding them, and all changes that fall within the metes and bounds of the claims or that form their functional as well as conjointly cooperative equivalents are, therefore, intended to be embraced by those claims.

I claim:

1. An exhaust gas recycling system, comprising in combination:

an internal combustion engine having an exhaust manifold and an inlet manifold;

a carburetor on the inlet manifold;

an air cleaner housing on the carburetor and having a tubular air intake horn;

a first one-piece bypass pipe connected to the exhaust manifold and having one end thereof terminating in the plane of an opening in the exhaust manifold and having a baffle thereon projecting through the opening into the manifold for directing exhaust gases into the bypass pipe;

a silencer connected to the other end of the first bypass pipe; and a second one-piece bypass pipe joined at one end thereof to the silencer and extending at its other end into an opening in the side of the air cleaning housing horn, the longitudinal axis of the other end of the second bypass pipe being perpendicular to the longitudinal axis of the horn, whereby air flowing through the horn creates a low pressure in the bypass pipes and draws exhaust gas through the pipes into the carburetor in direct proportion to the amount of air flowing thereinto, said first and second bypass pipes, baffle and silencer comprising the only elements added to the existing manifolds and carburetor.

* * * * *